United States Patent [19]

Reinehr et al.

[11] 4,067,948

[45] Jan. 10, 1978

[54] PROCESS FOR THE PRODUCTION OF HIGH-SHRINKAGE WET-SPUN ACRYLIC FIBRES OR FILAMENTS

[75] Inventors: Ulrich Reinehr; Alfred Nogaj; Toni Herbertz, all of Dormagen, Germany

[73] Assignee: Bayer Aktiengesellschaft, Leverkusen, Germany

[21] Appl. No.: 705,886

[22] Filed: July 16, 1976

[30] Foreign Application Priority Data

July 18, 1975 Germany ..... 2532120

[51] Int. Cl.[2] ..... D01F 6/18

[52] U.S. Cl. ..... 264/182; 264/210 F

[58] Field of Search ..... 264/182, 234, 210 F

[56] References Cited

U.S. PATENT DOCUMENTS

| | | | |
|---|---|---|---|
| 3,781,391 | 12/1973 | Shimoda et al. | 264/182 |

FOREIGN PATENT DOCUMENTS

| | | | |
|---|---|---|---|
| 41-20414 | 11/1966 | Japan | 264/182 |
| 42-13747 | 8/1967 | Japan | 264/182 |
| 45-39466 | 12/1970 | Japan | 264/182 |

*Primary Examiner*—Jay H. Woo

*Attorney, Agent, or Firm*—Plumley and Tyner

[57] ABSTRACT

The invention relates to a process for the production of high-shrinkage wet-spun acrylic fibres having good fibre strength and high densities by fixing the unstretched fibres with saturated steam and then stretching in a ratio of from 1:3,5 to 1:5.

5 Claims, No Drawings

PROCESS FOR THE PRODUCTION OF HIGH-SHRINKAGE WET-SPUN ACRYLIC FIBRES OR FILAMENTS

This invention relates to a process for the production of high-shrinkage wet-spun acrylic fibres or filaments.

In the context of the invention, high-shrinkage fibres and filaments are fibres with a boiling-induced shrinkage of more than 30%, preferably more than 35%.

High-shrinkage acrylic fibres of the kind in question are known, for example, from U.S. Patent Specification No. 3,097,415. In the process described in this U.S. Pat. Specification, it is possible to obtain shrinkage levels of at least 35% and densities of at least 1.170 by washing the undrawn spun material to remove most of the solvent, subsequently drying it at temperatures of from 100° to 130° C to a moisture content of at most 10%, treating it with water or steam at temperatures of from 96° C to 110° C and, finally, drawing it in a ratio of from 1:1.5 to 1:2.5. The process is said to be applicable to dry-spun and wet-spun filaments and fibres.

However, one disadvantage of this process is that the drying operation referred to is unavoidable, in addition to which the resulting filaments lack strength on account of the relatively low drawing ratio. If, however, the drawing ratio is increased, there is a distinct reduction in shrinkage capacity.

By contrast, the process described in German Offenlegungsschrift No. 1,660,328 provides an improvement in two respects: dry-spun material is treated with steam at temperatures of from 100° to 180° C in the absence of the drying operation required in accordance with the above-mentioned U.S. Pat. Specification, and is subsequently drawn in a ratio of from 1:1.8 to 1:3.2 at temperatures of preferably from 65° to 95° C. The shrinkage levels obtainable in this way are distinctly higher than those obtainable by the process according to the U.S. Pat. Specification.

However, even the fibre strengths obtained by the process according to the German Offenlegungsschrift are not optimal because limits are imposed on the drawing ratio in cases where it is desired to obtain high-shrinkage fibres.

It is also known (cf. U.S. Patent Specification No. 3,180,913) that high-shrinkage acrylic fibres can be obtained by predrawing wet-spun filaments in a ratio of up to 1:2.5, followed by drying and treatment with steam, and post-drawing them in a ratio of up to 1:3.0 at 70° to 90° C. Although it is possible by this process to obtain adequate fibre strengths and high shrinkage levels, the drying process required in between is unfavourable because further wet treatment is carried out in the form of the post-drawing process.

Accordingly, there is still a need for a simple process by which it is possible to produce acrylic fibres with high shrinkage levels and high fibre strengths. It is an object of the present invention is to provide such a process.

It has now surprisingly been found that the required filaments and fibres can be obtained by fixing wet-spun material with saturated steam and subsequently drawing it in a higher ratio than has hitherto been possible with dry-spun material.

Accordingly, the present invention relates to a process for the production of high-shrinkage filaments and fibres of an acrylonitrile polymer or copolymer containing at least 50% by weight of polymerised acrylonitrile which comprises fixing the undrawn wet-spun material with saturated steam at a temperture of from 110° to 180° C for at least one minute and then drawing in a ratio of from 1:3.5 to 1:5.0.

In this process, fixing with saturated steam should last at least one minute to ensure that adequate shrinkage properties are obtained. However, fixing for longer than 20 minutes is not recommended because otherwise the material becomes thermoplastic. Fixing times of from 2 to 8 minutes are preferred.

It is completely surprising that excellent shrinkage levels coupled with satisfactory fibre strengths can be obtained with drawing ratios of from about 1:3.5 to about 1:5 which are unusually high for the production of high-shrinkage types. The best results in regard to shrinkage and fibre strengths are obtained with drawing ratios of from about 1:3.5 to about 1:4.5.

Drawing may be carried out in aqueous medium at temperatures of from 75° to 100° C. It is surprising that drawing can even be carried out at boiling temperature which is not possible with dry-spun material because shrinkage capacity decreases drastically. The higher the drawing temperature, the better (higher) is, for example, the density of the fibres, so that as high a drawing temperature as possible is desirable. Accordingly, drawing is preferably carried out at temperatures in the range from 95° to 100° C.

Accordingly, the advantage of the process according to the invention over the known processes referred to above is that not only does it eliminate the need for drying, it also gives fibres with shrinkage levels of up to 50% and higher coupled with fibre strengths of the order of 2 p/dtex. In addition, the fibres obtainable in accordance with the invention have densities of 1.17 and higher, so that they have a vacuole-stable structure. As a result, there are, for example, no undesirable changes in colour and lustre in finished articles produced from the fibres according to the invention. In the case of acrylic fibres, vacuole-free structures can be assessed not only by scattered light and gloss measurements but also by determining fibre density. Methods for determining fibre density are described in the literature, cf. for example H. De Vries and H. G. Wejland in Textile Research Journal 28, No. 2 pages 183–184 (1958).

The process according to the invention may be carried out with polyacrylonitrile or preferably with acrylonitrile copolymers containing at least 50% by weight of polymerised acrylonitrile and most preferably at least 85% by weight of acrylonitrile. Copolymers of this kind contain one or more ethylenically unsaturated monomers, for example, acrylic acid esters, for example methyl acrylate, vinyl esters, for example vinyl acetate, or monomers containing dye-receptive groups, for example allyl or methallyl sulphonic acid or their alkali salts.

The invention is further illustrated but by no means limited by the following Examples in which parts or percentages relate to weight unless otherwise indicated.

EXAMPLE 1

An acrylonitrile copolymer of 93.6% of acrylonitrile, 5.7% of methyl acrylate and 0.7% of sodium methallyl sulphonate was wet-spun from dimethyl formamide by conventional methods. The tow with an overall denier of 1,400,000 dtex was washed with water at 50° C, fixed with saturated steam for 7 mins at 120° C in a steaming box, drawn in a ratio of 1:3.5 at 75° C, treated with antistatic preparation and moist crimped. The fibre shrinkage of the crimped tow, as measured on a series of individual filaments amounts to 54.7%. The tow was then cut into staple fibres which were dried at 50° C. The final individual fibre denier was 5.4 dtex. The fibre shrinkage of a series of individual filaments amounts to 51.5% in boiling water. Fibre strength: 1.9 p/dtex; density: 1.181 g/cc.

Table I below shows some fibre shrinkage values, strengths and densities of wet-spun acrylic fibres produced and aftertreated in accordance with Example 1 in dependence upon the drawing ratio the drawing temperature and the steaming time at a steaming temperature of 120° C.

Table I

| Test | Steaming time (mins) | Drawing ratio | Drawing temperature (° C) | Denier (dtex) | Fibre shrinkage (%) | Strength (p/dtex) | Density g/cc |
|---|---|---|---|---|---|---|---|
| 1 | 1 | 1:3.5 | 75 | 5.4 | 49.4 | 1.8 | 1.176 |
| 2 | 1 | 1:4.0 | 75 | 4.7 | 45.6 | 2.1 | 1.179 |
| 3 | 1 | 1:3.5 | 100 | 5.3 | 44.7 | 2.0 | 1.181 |
| 4 | 1 | 1:4.0 | 100 | 4.6 | 39.9 | 2.2 | 1.180 |
| 5 | 1 | 1:5.0 | 100 | 3.7 | 34.2 | 2.5 | 1.181 |
| 6 | 5 | 1:3.5 | 75 | 5.3 | 52.3 | 1.9 | 1.174 |
| 7 | 5 | 1:4.0 | 75 | 4.6 | 50.4 | 2.1 | 1.179 |
| 8 | 5 | 1:3.5 | 100 | 5.4 | 45.6 | 2.0 | 1.183 |
| 9 | 5 | 1:4.0 | 100 | 4.7 | 46.5 | 2.2 | 1.178 |
| 10 | 5 | 1:5.0 | 100 | 3.8 | 39.0 | 2.6 | 1.175 |

As can be seen from the Table, higher fibre shrinkage levels are obtained with longer steaming times. Surprisingly, wet-spun steam-treated acrylic fibres still give fibre shrinkage values of more than 40% even at a drawing temperature of 100° C and for a drawing level of from 400 to 500%.

EXAMPLE 2

An acrylonitrile copolymer with the same chemical composition as in Example 1 was wet-spun. The resulting tow (overall denier 1,400,000 dtex) was washed at 50° C, steamed for 3 minutes at 105° C in the absence of tension over a screen belt steamer, drawn in a ratio of 1:3.5 at a temperature of 75° C and aftertreated in the same way as described in Example 1. The final individual fibre denier was 5.5 dtex. The fibre shrinkage, as measured on a series of individual fibres, amounted to 33.2% in boiling water. Density: 1.174 g/cc. The steaming conditions were not sufficient to produce fibres with a shrinkage capacity of more than 40%.

Table II below shows fibre shrinkage values of wet-spun acrylic fibres, which have been produced and aftertreated in accordance with Example 1 and which have the same chemical composition as in Example 1, in dependence upon the steaming temperature and steaming time. The fibre shrinkage values were measured on a series of individual filaments in boiling water.

Table II

| Steaming time (mins) | Fibre shrinkage values (%) | | | |
|---|---|---|---|---|
| | Steaming temperature | 105° C | 110° C | 120° C |
| 1 | | 31.9 | 46.1 | 48.2 |
| 2 | | 33.0 | 47.2 | 48.8 |
| 4 | | 34.7 | 47.6 | 49.8 |
| 6 | | 37.4 | 47.7 | 49.5 |
| 8 | | 40.9 | 48.8 | 47.9 |
| 10 | | 39.6 | 46.9 | 47.3 |
| 15 | | 40.7 | 46.7 | 51.3 |
| 20 | | 39.8 | 47.6 | 52.2 |

It can be seen from Table II that high shrinkage fibres with a shrinkage capacity of more than 45% can only be obtained at sufficiently high steaming temperatures (at least 100° C). At these steaming temperatures the shrinkage level of the acrylic fibres under identical drawing conditions increases to a negligible extent only with increasing steaming time.

EXAMPLE 3 (Comparisons)

a. An acrylonitrile copolymer with the same chemical composition as in Example 1 was wet-spun and condensed into a tow with an overall denier of 1,400,000 dtex. The spun material was drawn in a ratio of 1:3.5 in water at 75° C, washed, finished and moist-crimped. The tow was then cut into staple fibres and dried at 50° C. Final individual fibre denier: 3.5 dtex. Fibre shrinkage: 31.4%; density: 1.163 g/cc; strength: 1.8 p/dtex.

b. Some of the spun material was intensively washed for 30 seconds under tension first at boiling temperature and then at room temperature, subsequently drawn in a ratio of 1:3.5 at 75° C and aftertreated in the same way. The fibre shrinkage of a series of individual filaments amounts to 37.6% in boiling water. Density: 1.159 g/cc.

c. Some more of the spun material was pre-drawn in a ratio of 1:1.2 at 100° C, washed at 50° C and post-drawn in a ratio of 1:2.5 at 75° C, giving a total drawing ratio of 1:3.0. This was followed by aftertreatment in the same way as in Example 3*a*. The fibre shrinkage of a series of individual filaments amounts to 35.9% in boiling water. Variations in the drawing ratios and drawing temperatures produce no further significant increase in the shrinkage of the fibres.

What we claim is:

1. A process for the production of high-shrinkage filaments and fibres of an acrylonitrile polymer or copolymer containing at least 50% by weight of polymerised acrylonitrile and the balance of one or more monomers copolymerizable therewith which comprises fixing the undrawn wet-spun material with saturated steam at a temperature of from 110° to 180° C for at least one minute and then drawing in a ratio of from 1:3.5 to 1:5.0.

2. The process of claim 1, wherein the fibres or filaments are drawn in a ratio of from 1:3.5 to 1:4.5.

3. The process of claim 1, wherein said fixing is carried out for a period of from 2 to 8 minutes.

4. The process of claim 1, wherein said copolymer comprises at least 85% by weight of acrylonitrile.

5. The process of claim 1, wherein said drawing is carried out in an aqueous medium at a temperature of from 75° to 100° C.

* * * * *